United States Patent [19]

Farmont

[11] 4,344,263

[45] Aug. 17, 1982

[54] BUILDING LOG WITH HIGH THERMAL INSULATION CHARACTERISTICS

[76] Inventor: Johann H. Farmont, 433 Golden Gate Ave., Belvedere, Calif. 94920

[21] Appl. No.: 172,522

[22] Filed: Jul. 28, 1980

[51] Int. Cl.[3] ..... E04B 1/10

[52] U.S. Cl. ..... 52/233; 52/407; 52/595

[58] Field of Search ..... 52/233, 309.4, 514, 52/595, 437, 442, 404, 593, 407, 405, 410, 426, 427

[56] References Cited

U.S. PATENT DOCUMENTS

| | | | |
|---|---|---|---|
| 830,094 | 9/1906 | Momsen | 52/303 |
| 1,669,541 | 5/1928 | Spreen | 52/514 |
| 2,004,553 | 6/1935 | Een | 52/514 |
| 2,665,455 | 1/1954 | Salo | 52/595 |
| 3,546,833 | 12/1970 | Perreton | 52/437 |
| 3,992,838 | 11/1976 | Vizziello | 52/309.4 |
| 4,126,977 | 11/1978 | Chisum | 52/595 |

FOREIGN PATENT DOCUMENTS

| | | | |
|---|---|---|---|
| 476660 | 9/1951 | Canada | 52/233 |
| 622653 | 6/1961 | Canada | 52/595 |
| 783292 | 4/1968 | Canada | 52/233 |

*Primary Examiner*—James L. Ridgill, Jr.
*Attorney, Agent, or Firm*—Melvin R. Stidham

[57] ABSTRACT

A wood log of substantial thickness and having flat top and bottom surfaces interrupted by complementary tongues and grooves along the length thereof. One or more slots open from at least one of the surfaces with the total slot depth extending over all but a small portion of the top to bottom thickness of the log. The slots are filled with an insulating material.

4 Claims, 6 Drawing Figures

BUILDING LOG WITH HIGH THERMAL INSULATION CHARACTERISTICS

BACKGROUND OF THE INVENTION

While wood has high thermal insulating characteristics and relatively thick wood logs five to eight inches in thickness provide excellent insulation, building regulations, which have been adopted in some areas require an R factor which is difficult to achieve with wood logs alone.

OBJECTS OF THE INVENTION

It is an object of this invention to provide a wood log having high thermal insulation characteristics.

It is a further object of this invention to provide a wood log which can be stacked to provide a complete wall structure without requiring a covering of insulation material.

Other objects and advantages of this invention will become apparent from the description to follow, particularly when read in conjunction with the accompanying drawings.

SUMMARY OF THE INVENTION

In carrying out this invention, I provide log lengths having relatively planar top and bottom surfaces, though with one or more tongues along one of said surfaces and a complementary number of matching grooves in the other of said surfaces so that logs may be readily stacked and nested to produce a rigid construction with minimum requirement for nailing. At least one of the top and bottom surfaces is interrupted by one or more deep slots which extend over substantially the full top to bottom thickness of the log, and the slots contain an insulation material, such as styrofoam or polyurethane. The slots may extend from one surface to substantially the full thickness; they may extend from the same or opposite surface along generally parallel planes.

DESCRIPTION OF PREFERRED EMBODIMENTS

Figure 1:
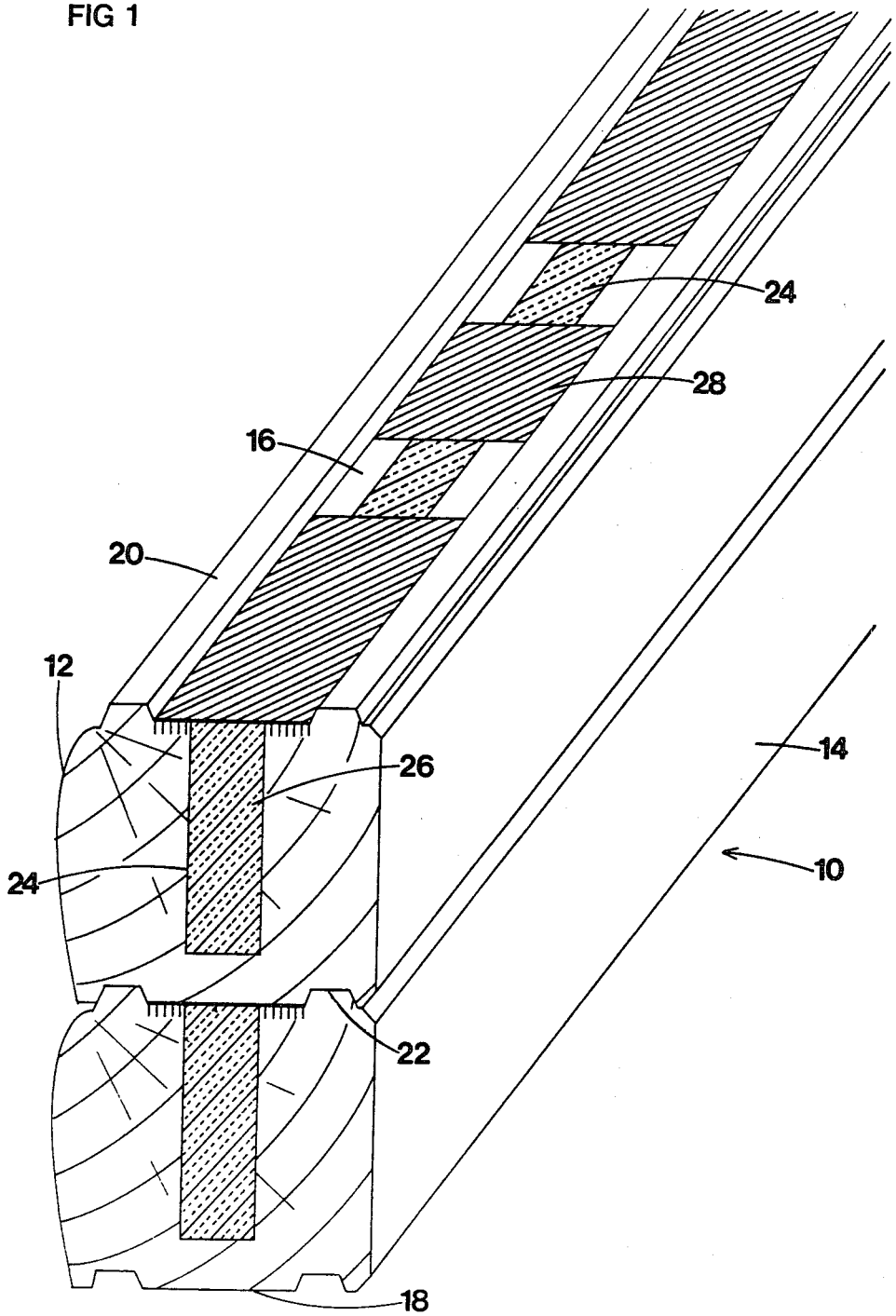
FIG. 1 is a section view in perspective of one embodiment of this invention.

The Embodiment of FIG. 1

Referring now to FIG. 1 with greater particularity the logs 10 of this invention may, if desired, have rounded front surfaces 12, generally planar back surface 14 and, essentially, complementary horizontal planar top and bottom surfaces 16 and 18. One of the planar surfaces e.g. the top surface is interrupted by tongue ridges along the length of the log 10 and the bottom surface is interrupted by complementary grooves 22. Hence, the logs 10 may be stacked as indicated, with tongues nested in grooves to provide a rigid wall construction that is extremely stable with minimum nailing, except to meet existing building codes.

A wide slot 24 is cut into one of the planar surfaces, e.g. the top surface 16 to extend almost the full depth of the log 10. The slot, if void, would provide improved heat insulation characteristics by reason of the fact that air is an insulator, but preferably as shown, the slot is filled with an insulating material 26, such as styrofoam, polyurethane or the like. Hence, except for a small, lower portion of the log, the thermal "paths" between the front and rear walls 12 and 14 are interrupted by insulation material 26 to provide a log having a total insulation factor which is extremely high. With the wide slot 24 penetrating deeply into the log 10, a series of reinforcing metal nailer strips 28 may be nailed into the top surface 16 to maintain structural integrity.

Figure 2:
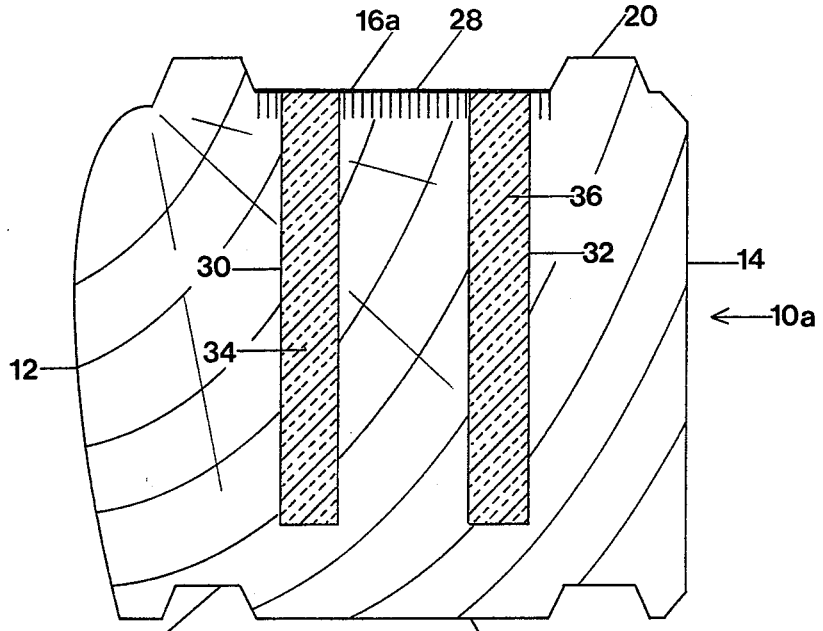
FIGS. 2, 3, 4 and 5 are section views of other embodiments of this invention.

The Embodiment of FIG. 2

In this embodiment, the log 10*a* is provided with a pair of parallel slots 30 and 32 from the top surface 16*a*. The slots 30 and 32 may be narrower than the slots of FIG. 1, but as in that embodiment, contain insulating material 34 and 36 to augment the natural insulation characteristics of the wood. Metal nailer reinforcement plates may also be added for structural integrity.

Figure 3:
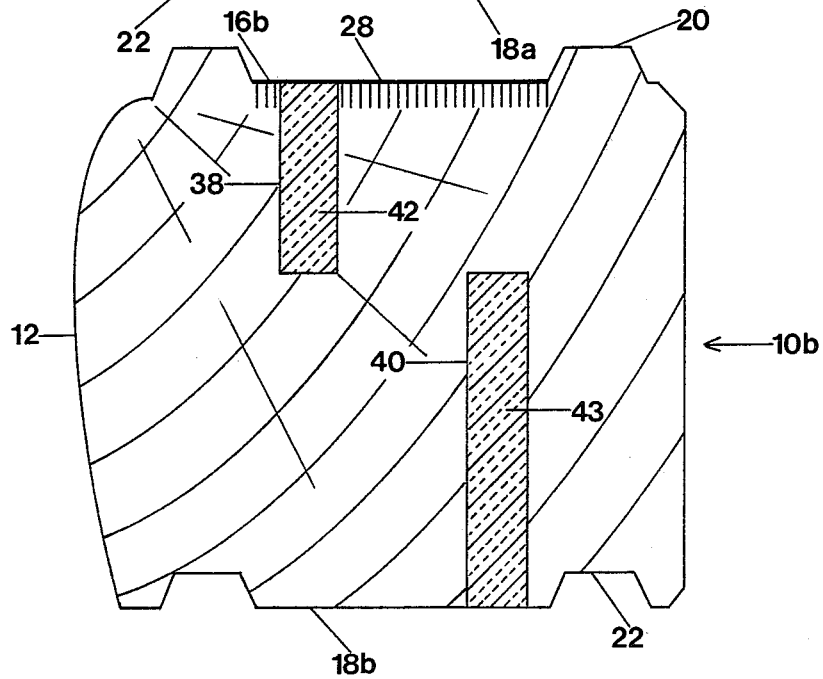

The Embodiment of FIG. 3

In this embodiment, the log 10*b* is provided with a pair of offset slots 38 and 40 from the top 16*b* and bottom 18*b* surfaces, respectively. Together, the slots 38 and 40 extend over the full top to bottom thickness of the log. If desired, the slot 38 may be made even deeper so that the slots 38 and 40 actually overlap. In any event, the slots 38 and 40 are filled with an insulation materials 42 and 43 as in previous embodiments.

Figure 4:
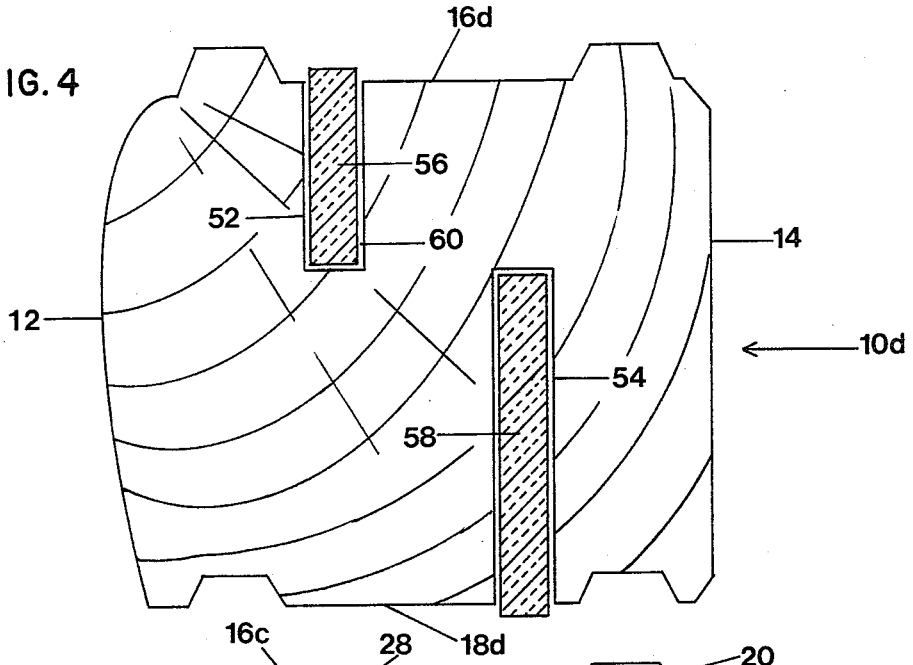

The Embodiment of FIG. 4

In this embodiment, the log 10*c* is provided with a pair of slots 44 and 45 of substantial width which open from the top surface 16C and the bottom surface 18C, respectively. The slots extend toward each other in substantial alignment but do not connect, being bridged by a portion 46 of wood. As in previous embodiments, the slots 44 and 45 may be filled with an insulation material 50 and 51, and both top and bottom surfaces 16*c* and 18*c*, or either of them, may be reinforced by the metal nailer plates 28.

Figure 5:
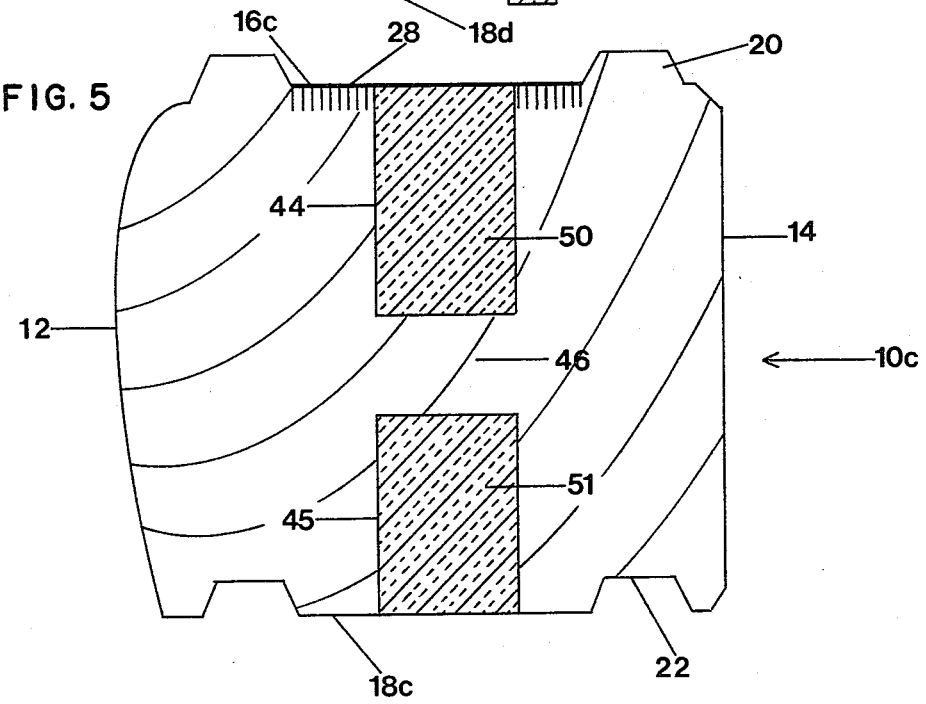

The Embodiment of FIG. 5

The log 10*d*, is provided with a pair of slots 52 and 54, which open from the top 16*d* and bottom 18*c* surfaces, respectively. The slots 52 and 54 are out of alignment and therefore, may penetrate to substantially the same horizontal plane, or even overlap. In this embodiment, lengths 56 and 58 of a solid insulation material are inserted into the slots 52 and 54 so as to protrude therefrom. Clearances 60 are provided around the insulation lengths 56 and 58 so that when the insulation lengths are engaged by the surface 16*d* or 18*d* of an adjacent stacked log 10*d*, pressure points will be established at the areas of engagement and the insulation will tend to bulge outward to, at least partially, fill the clearances 60.

Figure 6:
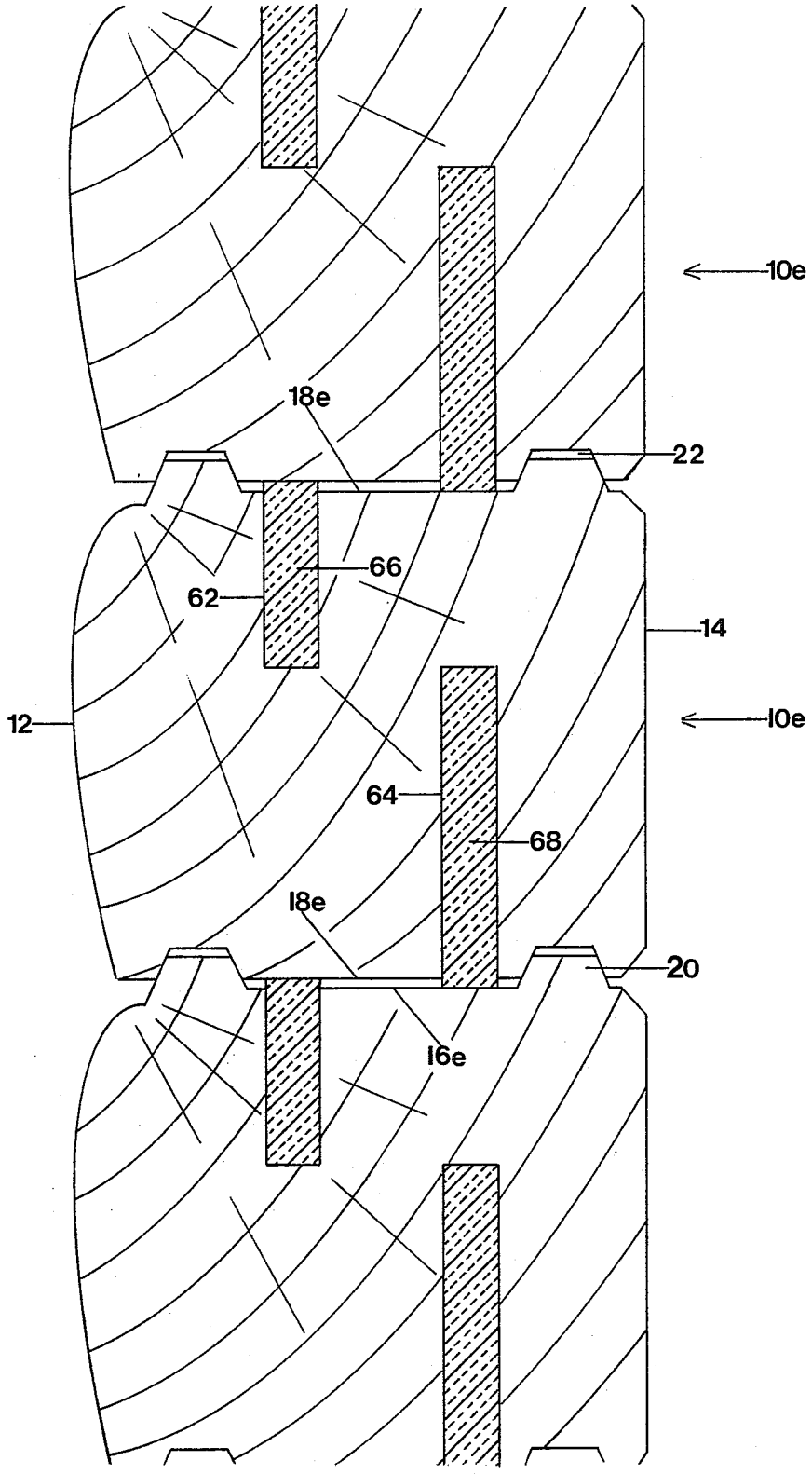
FIG. 6 is a view in section showing a stack of logs of still another embodiment.

The Embodiment of FIG. 6

Here, the log 10*e* has slots 62 and 64 cut in both surfaces 16*e* and 18*e* in the manner similar to that of FIG. 3. However, lengths of a solid insulating material 66 and 68, which are placed in the slots 62 and 64, are of lengths to protrude from the slots to establish pressure points with the complementary flat surface 16*e* or 18*e* of adjacent stacked logs.

All of the log embodiments here disclosed, logs 10 to 10*e*, may be of substantial thickness of, say five to eight inches, providing considerable natural thermal insulation, which is augmented by commercially available insulation materials. The result is a log which provides a superior component for an exterior wall for use in climates ranging to the most severe.

While this invention has been described in conjunction with preferred embodiments thereof, it is obvious that modifications and changes therein may be made by those skilled in the art to which it pertains, without departing from the spirit and scope of this invention, as defined by the claims appended hereto.

What is claimed as invention is:

1. A wood log of substantial thickness;

said log having complementary top and bottom surfaces adapted to stack with complementary surfaces on other logs;

one of said surfaces including:

a pair of parallel tongues formed thereon to extend along the length thereof adjacent the edges thereof; and a planar surface between said tongue;

the other of said surfaces including:

a pair of complementary parallel grooves formed therein to extend along the length thereof adjacent the edges thereof to receive the parallel tongues of an adjacent one of stacked logs; and a planar surface between said tongues;

at least one vertical slot along the length of said log;

each slot opening into one of said top and bottom planar surfaces;

thermal insulation material in each of said slots;

said slots extending through the major portion of the top to bottom thickness of said log; and at least one metal reinforcing plate nailed to, and extending substantially across, said one planar surface along the length thereof to span said vertical slot.

2. The wood log defined by claim 1 wherein:

there are a pair of generally parallel slots opening from the same one of said surfaces.

3. The wood log defined by claim 1 wherein:

one of said slots opens from each of said surfaces with inboard surfaces thereof in generally parallel planes.

4. The wood logs defined by claim 1 wherein:

one of said slot open from each of said surfaces to extend toward the other of said slots.

* * * * *